United States Patent [19]

Baboian et al.

[11] 4,407,711

[45] Oct. 4, 1983

[54] CORROSION PROTECTION SYSTEM FOR HOT WATER TANKS

[75] Inventors: Robert Baboian, Johnston, R.I.; Gardner Haynes, Attleboro, Mass.

[73] Assignee: Texas Instruments Incorporated, Dallas, Tex.

[21] Appl. No.: 270,945

[22] Filed: Jun. 5, 1981

Related U.S. Application Data

[62] Division of Ser. No. 90,776, Nov. 2, 1979.

[51] Int. Cl.[3] ..... C23F 13/00

[52] U.S. Cl. ..... 204/196; 204/147; 204/228; 204/286; 204/290 F

[58] Field of Search ..... 204/147, 148, 196, 197

[56] References Cited

U.S. PATENT DOCUMENTS

| | | | |
|---|---|---|---|
| 2,752,308 | 6/1956 | Andrus | 204/196 |
| 2,908,623 | 10/1959 | Doring | 204/196 |
| 2,996,445 | 8/1961 | Eisenberg et al. | 204/196 |
| 3,022,242 | 2/1962 | Anderson | 204/196 |
| 3,133,872 | 5/1964 | Miller et al. | 204/196 |
| 3,135,677 | 6/1964 | Fischer | 204/196 |
| 3,258,612 | 6/1966 | Rubelmann | 204/196 |
| 3,303,118 | 2/1967 | Anderson | 204/196 |
| 3,313,721 | 4/1967 | Teel | 204/196 |
| 3,373,100 | 3/1968 | Rubelmann | 204/196 |
| 3,374,162 | 3/1968 | Rubelmann | 204/196 |
| 3,475,311 | 10/1969 | Hosford | 204/196 |
| 3,616,418 | 10/1971 | Anderson | 204/196 |

*Primary Examiner*—T. Tung

*Attorney, Agent, or Firm*—John A. Haug; James P. McAndrews; Melvin Sharp

[57] ABSTRACT

Protection from corrosive effects of water in hot water tanks is provided by an electrochemically active noble metal type anode disposed in the hot water tank and supplied by a selected level of current passing from the anode through the water to the tank. The anode is configured in such manner as to cause the current to be distributed throughout the entire tank and thus for a conventional tank takes the form of a long thin anode. The noble metal is shown to be clad or plated onto an electrically conductive and, under anodic conditions, chemically inert strip of metal supported on a suitable electrically insulative member. The power supply provides a minimum protective current for water having low corrosivity characteristics, a maximum protective current for water having high corrosivity characteristics and intermediate these two extremites a level which varies with the degree of corrosivity of the water.

2 Claims, 6 Drawing Figures

CORROSION PROTECTION SYSTEM FOR HOT WATER TANKS

This is a division of application Ser. No. 90,776, filed Nov. 2, 1979.

This invention relates generally to corrosion protection of hot water tanks and more specifically to impressed current protection of such tanks.

Since hot water tanks are typically made of steel or similar corrodible material it has become conventional to provide corrosion protection for such tanks. In addition to coating the steel with glass or similar material it is known to provide sacrificial anodes such as magnesium, zinc and aluminum. However, such anodes suffer from certain inherent limitations. For instance, their useful life can be quite short (e.g., as little as six months), depending upon the degree of corrosivity of the water. Sacrificial anodes also are ineffective for protecting portions of the tank located remotely from the anode, that is, their so called throwing power is limited. Further, in order to ensure effective protection the size and placement of the anodes must be planned for a worst case situation which results in a larger and more expensive anode system than is required in many instances.

Attempts at providing protection utilizing impressed current techniques have been made but thus far have not been completely satisfactory. For example, as set forth in U.S. Pat. No. 4,136,001 a plurality of spaced anodes are mounted on a conductive wire in order to direct current to the entire areas of the tank's interior surface. However, use of spaced, discrete anodes makes it very difficult to obtain even current distribution. Further, even if it is desired to concentrate greater current density in certain areas i.e., near the discrete anodes it is not always possible to predict the areas which need this greater current density, areas for instance which have flaws, for example areas which have been inadequately coated with glass lining material. Another limitation in the referenced system is the type of power supply used to control the current from the anode to the tank surface. There is no provision made to account for variances in the corrosivity of water. Such variances could cause too little current to provide effective protection for one degree of corrosivity or more current than is needed with attendent unnecessary and undesirable gassing for another degree of corrosivity. Other impressed current protection approaches have involved anodes which are short lived, such as anodes of high silicon iron which are not truly electrochemically inert, have had ineffective anode configurations causing poor current distribution for a given tank or have been unsatisfactory for some other reason.

It is therefore an object of the invention to provide a protection system which will effectively protect a hot water tank from corrosion. Another object is to provide an impressed current protection system which has a power supply which is regulated to provide an optimum level of protective current for any given level of corrosivity. Yet another object of the invention is the provision of an anode particularly well suited for use with an impressed current protection system for hot water tanks which is reliable, efficient, readily manufacturable and of reasonable cost.

Other objects, advantages and details of construction of the method and apparatus provided by this invention appear in the following detailed description of preferred embodiments of the invention, the detailed descriptions referring to the drawings in which FIG. 1 is a front elevation, partly broken away, of a hot water tank incorporating an anode and power supply made in accordance with the invention;

Briefly, according to the invention, an electrochemically active, non sacrificial noble metal type anode comprising an elongated strand having an outer layer of platinum, iridium, ruthinium or their alloys clad or coated on a strand of electrically conductive, and, under anodic conditions, chemically inert material such as titanium, columbium and tantalum which is disposed on a suitable electrically insulative support and placed within a tank extending along essentially the entire length of the tank. One embodiment of the electrode comprises an insulative rod having an axially extending channel which receives the anode strands while another embodiment utilizes a tubular water inlet with the anode strand wrapped helically thereabout. A power supply comprising a constant voltage branch and a constant current branch provides a regulated protective current based on the corrosivity of the water in the tank and includes a maximum current level for highly corrosive water and a minimum current level for only slightly corrosive water.

Figure 1:
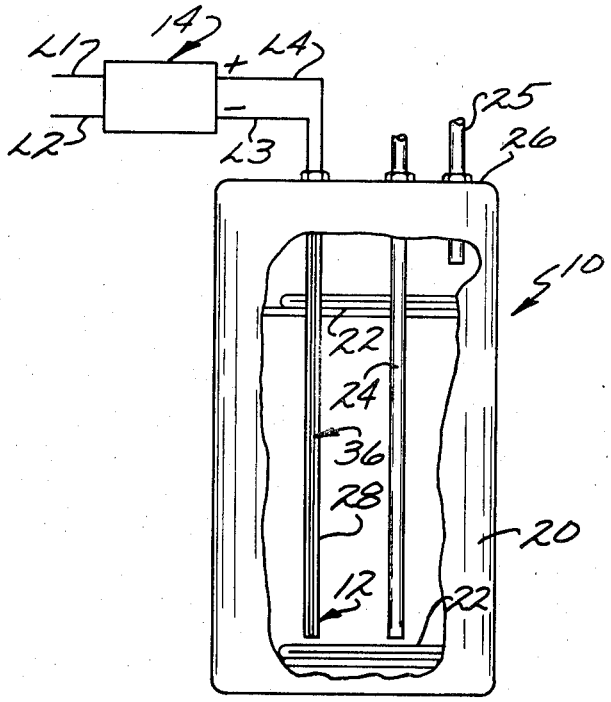
Figure 2:
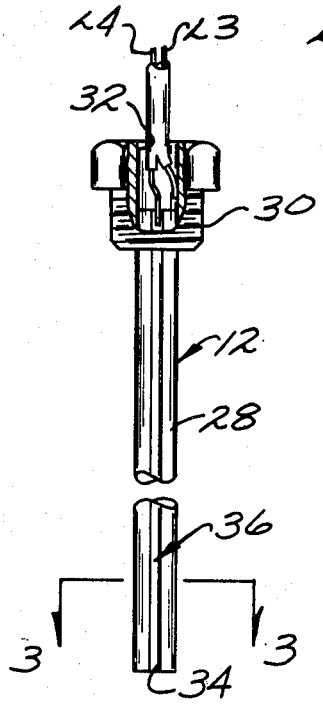
FIG. 2 is an enlarged front elevational view of an anode useful in the FIG. 1 hot water tank.
Figure 3:
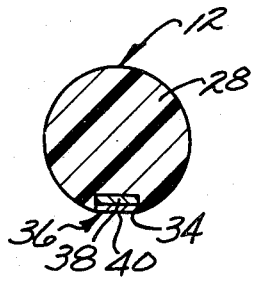
FIG. 3 is an enlarged cross sectional view taken on line 3—3 of FIG. 2.

Turning now to the drawings, FIG. 1 shows a conventional hot water tank 10 comprising an outer wall 20 of conventional galvanically active material such as steel lined with a coating of glass or other chemically inert material. Hot water tank 10 is provided with conventional heater elements 22 connected to a suitable heater control circuit (not shown). It will be understood that the invention applies equally well to hot water tanks employing other heating means, such as gas fired heaters. A suitable water inlet 24 and outlet 25 are shown extending through a top wall 26 of the tank into its interior. Also extending through top wall 26 is an anode 12 (see FIGS. 2 and 3) comprising a support rod 28 of electrically insulative material, such as polypropylene having an electrically conductive threaded head portion 30 adapted to be received in a threaded bore in wall 26. Anode support rod 28 extends over a major portion of the height of the tank to provide protective current to the entire interior surface of the tank. Head 30 is provided with a centrally disposed bore 32 which receives rod 28 therein as well as leads L3, L4. Lead L3 is attached, as by soldering, to head 30 while lead L4 is attached to the anode element described below. Bore 32 is then potted with a conventional electrically insulating, chemically inert potting material. A channel 34 is formed in rod 28 along its axial length and received therein is a non sacrificial anode element 36 comprising a base strand or layer 38 and an outer strand or layer 40. Base strand 38 is composed of an electrically conductive, and under anodic conditions, essentially chemically inert substance, such as titanium, columbium and tantalum. Strand 40, which may be clad to strand 38 by conventional metal cladding techniques such as solid phase roll bonding, or may be coated onto strand 38, is composed of an electrochemically active noble metal such as platinum, iridium, ruthenium and their alloys. Anode element 36 is maintained in channel 34 in any convenient manner as by use of spots of adhesive, thermally deforming portions of rod 28 at spaced axial locations to overlap small portions of anode element 38, or other fastening means.

The specific dimensions selected for strands 38 and 40 are selected to provide adequate current for the surfaces to be protected and thus depend on the size and configuration of the particular tank being protected. In general, in a system in which columbium is employed for the base strand 38, a thickness of 0.001 to 0.050 inch is suitable with 0.010 to 0.015 inch being optimum for most applications. With platinum used for strand 40 a thickness of 40 to 250 microinches is suitable with an optimum of approximately 40 microinches for most applications. For the above thickness a width of 0.020 inch has been found to be suitable.

Figure 4:
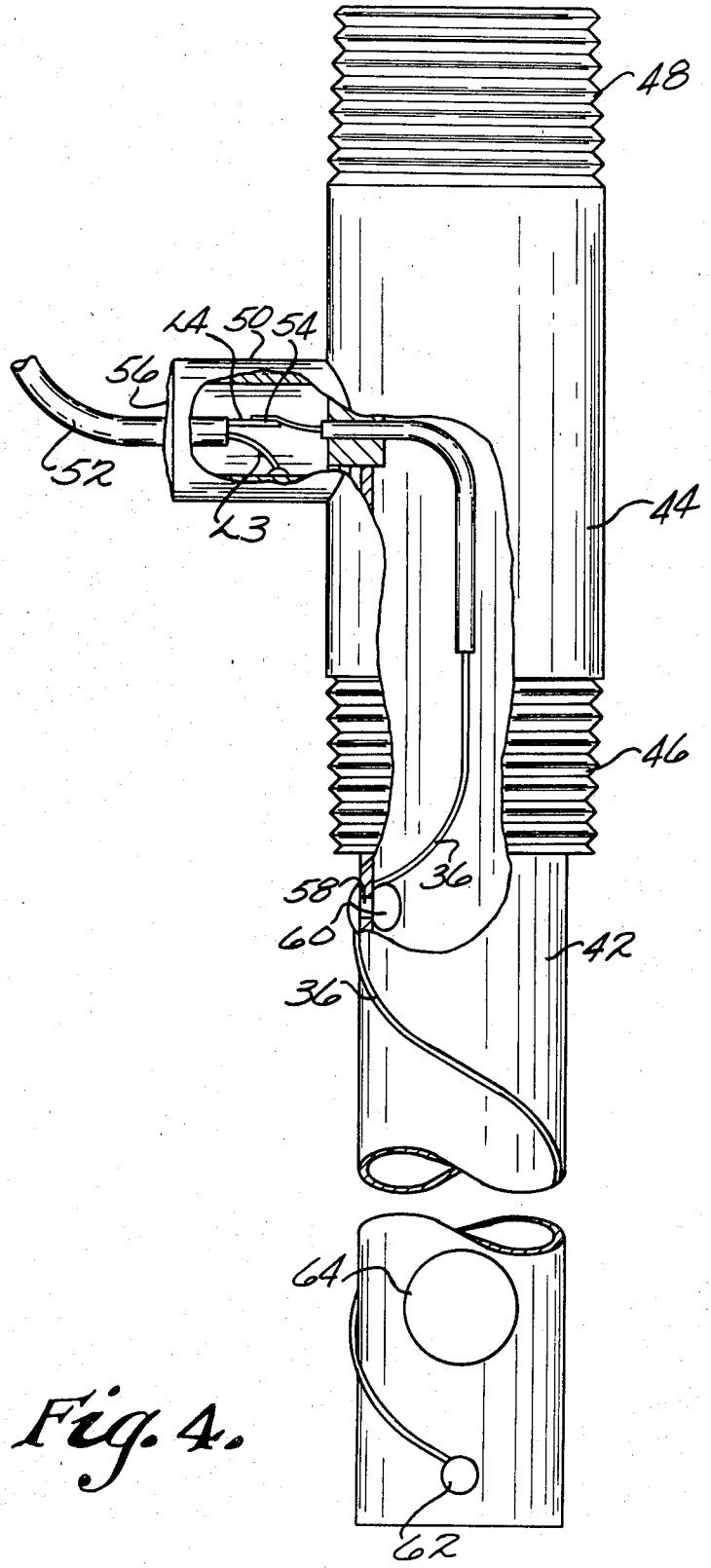
FIG. 4 is an enlarged front elevational view, partly broken away, of an alternate embodiment of the FIGS. 1–3 anode.

FIG. 4 shows an alternate embodiment in which the anode element 36 is supported on a water inlet tube 42. Tube 42, of electrically insulating material such as polypropylene is received in one end of an electrically conductive coupling 44 which is provided with a threaded portion 46 for mounting on the top wall of a hot water heater. A second threaded portion 48 facilitates attachment to a water supply conduit. A nipple 50 projects from coupling 44 and receives therethrough wire member 52. Wire member 52 comprises conductors L3 which is electrically attached to nipple 50, as by soldering, and L4 which is electrically attached to one end of anode element 36 in any conventional manner, as by soldering at 54. Nipple 50 is potted with a suitable electrically insulative, chemically inert material 56. Wire 52 may be provided with a female connector (not shown) to facilitate connection with power supply 14. An aperture 58 is provided in tube 42 with anode element 36 trained therethrough. A plastic plug 60 is used to anchor one portion of anode element 36 adjacent the above referred to end with another plastic plug 62 anchoring its opposite end. One or more apertures 64 is provided in tube 42 to permit water to pass therethrough. In a device made in accordance with FIG. 4, element 36 was comprised of a columbium base layer 0.010 inch thick by 0.030 inch wide with a 40 microinch layer of platinum clad thereto, element 36 was helically wound about tube 42 having a diameter of $\frac{3}{4}$ inch with a 6 inch pitch.

It should be noted that element 36 could be constructed out of round wire material as well as the flat strips shown in the drawings. In such a case copper could conveniently be used as the core even though it is not chemically inert under anodic conditions since it is completely surrounded by a jacket of noble metal.

Figure 5:
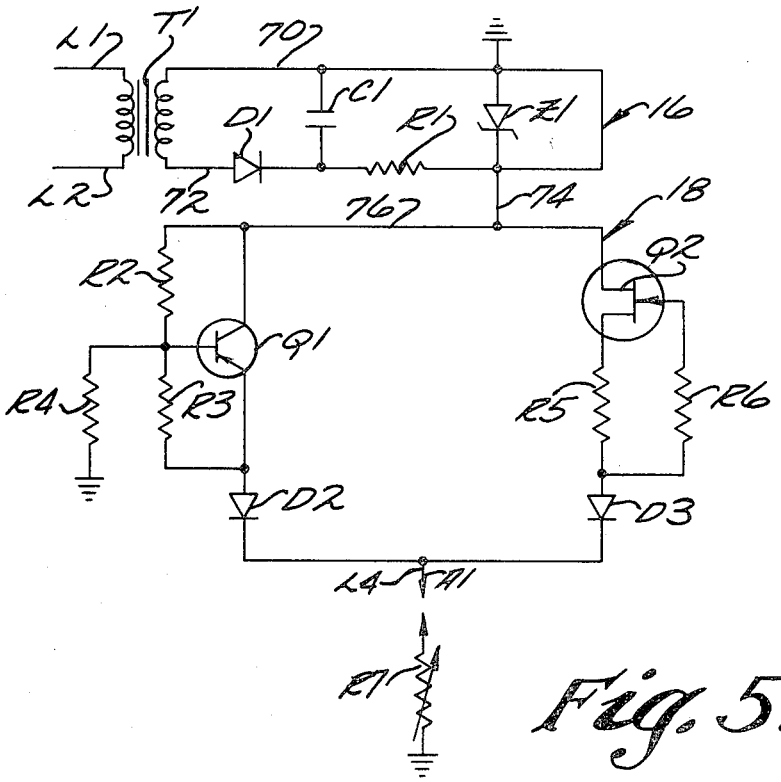
FIG. 5 is a circuit diagram of the power supply made in accordance with the invention.

With reference to FIG. 5 the control circuit 14 has a first circuit portion 16 comprising transformer T1 connected to lines L1, L2 connected across a 115 VAC source. The secondary of transformer T1 is connected to line 70 which is connected to one side of capacitor C1, zener diode Z1 and to ground. The other side of the secondary of transformer T1 is connected to line 72 which leads to diode D1 which in turn is connected to the other side of capacitor C1 and a resistor R1 which is connected to the other side of zener diode Z1 and to line 74 which leads to a second circuit portion 18 comprising lead 76 which leads to a constant voltage branch including an NPN transistor Q1. Lead 76 is connected to the collector of transistor Q1 and its emitter to diode D2 which in turn is connected to one side of anode A1 via line L4. Resistors R2 and R3 are connected across the collector, emitter electrodes with the interconnection between R2 and R3 connected to the base of transistor Q1 and to resistance R4 which in turn is connected to ground. Lead 76 is also connected to a constant current branch of circuit portion 18 including a field effect transistor Q2. The main electrodes of transistor Q2 are connected in line 76 to resistor R5 which in turn is connected to diode D3 and then to the one side of anode A1. A resistor R6 is connected between the gate electrode of transistor Q2 and a point intermediate resistor R5 and diode D3. The other side of anode A1 is connected to ground through the hot water tank, the water in the tank being designated in FIG. 5 as variable resistor R7. As seen in FIG. 1, line L4 connects the positive side of the power supply to anode 36 and line L3 connects the negative side of the power supply to ground through the hot water tank.

Transformer T1 steps down the AC voltage from 115 to 28 volts which is then rectified to direct current, filtered by capacitor C1 to reduce the ripple and regulated at 20 volts by the zener diode Z1. Resistance R1 serves to limit the current at an upper limit of 16 ma.

Under normal operating conditions the DC output of circuit portion 16 passes through the constant voltage branch of circuit portion 18 which maintains a selected voltage level to the anode, in this case 3.4 volts. This permits an anode current to follow decreasing water conductivities until a level of 5 ma is reached biasing transistor Q1 and causing the DC supply to pass through the field effect transistor Q2 of the constant current branch, which maintains 5 ma of current to the anode. This permits the desired minimum protective current to be maintained regardless of further decreases in the corrosivity of the water i.e., decreases in its conductivity. Thus regulation of desired protective current with changing levels of water corrosivity is accomplished by use of the described circuit.

By way of example a control circuit 14 was constructed with components having the following values:

| | | | |
|---|---|---|---|
| R1 | 680 Ω 1 watt | C1 | 50 μf50 V DC |
| R2 | 3.3K Ω | Z1 | 1N4747 |
| R3 | 10K Ω | D1 | 1N4006 |
| R4 | 1.0K Ω | D2 | 1N4006 |
| R5 | 680 Ω | D3 | 1N4006 |
| R6 | 1 meg Ω | Q1 | 2N2222 |
| | | Q2 | 2N5950 |

Figure 6:
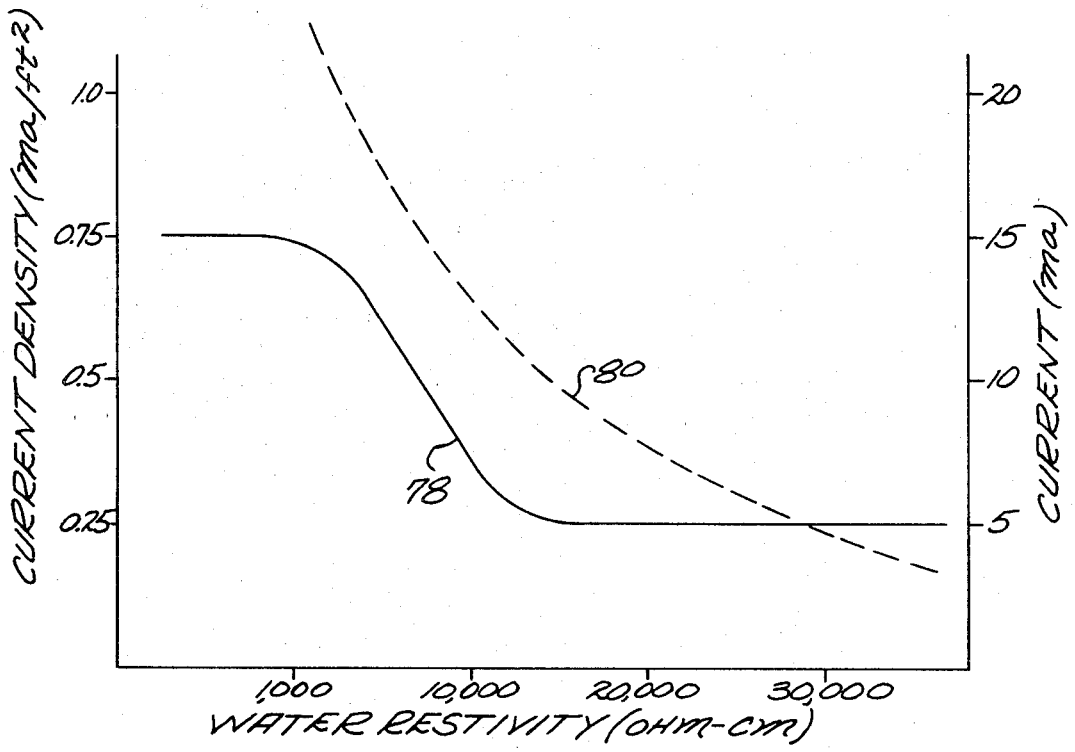
FIG. 6 is a chart showing current density and current plotted against water resistivity.

As seen in FIG. 6, curve 78 of current v water resistivity using the above circuit components with a typical forty gallon hot water tank, a minimum protective current of just under 5 milliamperes is provided for water having low corrosivity characteristics. For water having high corrosivity characteristics a maximum of approximately 15 milliamperes is provided. The level of protective current between the maximum and minimum values is shown to vary with the corrosivity of the water. Thus circuit 14 provides efficient corrosion protection for the hot water tank regardless of the particular corrosivity characteristics of the water. The value of the various components can be changed to provide selected maximum and minimum current levels to make them suitable for a tank of any selected size. Curve 78 of current density v water resistivity shown in FIG. 6 can be used in determining the component values required to obtain the desired protection current. That is, a maximum current density of approximately 0.75 ma/ft$^2$ and a minimum current density of approximately 0.25 or slightly under will provide the desired protective current.

Control circuit 14 having components of the values listed above used with the forty gallon tank resulted in the following data with three different levels of water resistivity (the inverse of corrosivity):

| | High | Medium | Low |
|---|---|---|---|
| Resistivity (ohm-cm) | 39K | 3K | 0.8K |
| Current (milliamp) | 4.9 | 14.9 | 16.2 |

As seen in FIG. 6, the dashed line 80 shows a current versus water resistivity trace of a prior art magnesium anode used in a galvanic current protection system for a hot water tank. It will be noted that at high levels of resistivity of the water (low corrosivity) the protective current becomes lower than desirable whereas at low levels of resistivity of the water (high corrosivity) the current level greatly exceeds that which is required for effective corrosion protection. This deleteriously effects the useful life of such anodes. However, by means of the present invention the protection current is maintained at an optimum level based for any given degree of water corrosivity.

It should be understood that although particular embodiments of the invention have been described by way of illustration, this invention includes all modifications and equivalents of the disclosed embodiments falling within the scope of the appended claims.

We claim:

1. An impressed current protection system for a hot water tank in which the tank is constructed at least in part of corrosively active material and in which an anode of electrochemically active noble metal is disposed in the tank, a power supply for the system comprising transformer means to supply a relatively low, constant voltage source, the output of the transformer means connected to the anode through two parallel circuit branches, means to provide a first level of anode current at values of water resistivity above a first selected amount and a second level of anode current at values of water resistivity below a second selected amount and to provide intermediate the first and second selected amounts a level of anode current which is inversely proportional with the value of resistivity of the water comprising a constant voltage branch having an NPN transistor whose collector is connected to the constant voltage source of the transformer means and whose emitter is connected to the anode, and a constant current branch which is adapted to conduct the second level of current at levels of water resistivity below the second selected amount.

2. An impressed current protection system according to claim 1 in which the constant current source comprises an FET whose main electrodes are connected between the transformer output and the anode and which is adapted to conduct the second level of current to the anode when the output of the NPN transistor of the constant voltage branch decreases to the said second level of current.

* * * * *